US007380638B2

(12) United States Patent
Willey

(10) Patent No.: US 7,380,638 B2
(45) Date of Patent: Jun. 3, 2008

(54) EXHAUST NOISE CONTROL FOR MOTORCYCLES

(76) Inventor: Barry A. Willey, 727 Ela Rd., Inverness, IL (US) 60067

( * ) Notice: Subject to any disclaimer, the term of this patent is extended or adjusted under 35 U.S.C. 154(b) by 243 days.

(21) Appl. No.: 11/379,922

(22) Filed: Apr. 24, 2006

(65) Prior Publication Data

US 2007/0246294 A1 Oct. 25, 2007

(51) Int. Cl.
*F01N 1/04* (2006.01)

(52) U.S. Cl. ..... 181/254; 181/250; 181/251; 181/252; 181/253; 181/257; 181/258; 181/264; 181/268; 181/275

(58) Field of Classification Search ..... 181/250, 181/251, 252, 253, 254, 257, 258, 264, 268, 181/275

See application file for complete search history.

(56) References Cited

U.S. PATENT DOCUMENTS 3,703,937 A * 11/1972 Tenney ..... 181/226
4,785,626 A * 11/1988 Shiraishi ..... 60/313
4,842,096 A * 6/1989 Fujitsubo ..... 181/252
5,979,596 A * 11/1999 Baker ..... 181/253
6,546,722 B2 * 4/2003 Sagara et al. ..... 60/324
2002/0134614 A1 * 9/2002 Chen ..... 181/252

OTHER PUBLICATIONS

Double Fire Brochure (4 pages).
Double Fire Brochure (20 pages).

* cited by examiner

*Primary Examiner*—Lincoln Donovan
*Assistant Examiner*—Jeremy Luks
(74) *Attorney, Agent, or Firm*—Vedder Price P.C.

(57) ABSTRACT

A noise control apparatus for a motorcycle exhaust system. The apparatus includes at least one exhaust pipe assembly having a direct pass-through mode and an indirect mode wherein exhaust gases are optionally directed through noise attenuating means. The apparatus includes at least one valve for controlling exhaust gas flow, a motor, a switch controlling said motor, a wire carrier, a wire connected between the carrier and the valve(s), and a rotary threaded drive shaft driven by the motor for moving the positioner. The threaded drive shaft includes radially extending and circumferentially facing stop means on both sides of said wire carrier. The valve is positioned under the control of the switch.

13 Claims, 4 Drawing Sheets

EXHAUST NOISE CONTROL FOR MOTORCYCLES

BACKGROUND OF THE INVENTION

The present invention relates to motorcycle accessories, and more particularly to system for alternately permitting opening and closing the exhaust pipes of the motorcycle to operate in a straight-pipe mode or a muffled mode. This opening and closing the muffler bypass results in a variation in the sound, from very loud (a straight pipe sound) to a muffled sound, and any number of intermediate sounds.

The straight pipe noise is created by exhaust gases which rush out the exhaust valves into the exhaust pipe(s) and out the tail pipe having no muffling action. Consequently such sounds are characteristic of what is termed a "straight pipe" exhaust sound. To attain the other sound, a more muffled or controlled sound is created when some or all of the exhaust gases pass through a chamber containing numerous baffles and/or packing of some sort, and thence through the remainder of the exhaust pipe or the tail pipe, resulting in a somewhat or greatly reduced exhaust system noise.

There have been an almost unlimited number of different sounds and noise levels for motorcycle exhausts. However, there has not been a reliable system for readily changing from a relatively loud noise level to a muffled volume in a simple, easy-to-manipulate manner. The places in which such loud level sounds are appropriate may be, for example, on the open road or at the drag races, whereas the muffled exhaust tone may be more appropriate for late night riding, for riding in the inner city, in residential areas, or another place where it is considered objectionable to have an open exhaust, created by a straight pipe or unmuffled escape of exhaust gases.

Of course, the ideal situation is one wherein the rider has a choice to select the muffled or unmuffled sound (or any sound in between) and may accomplish the task of quieting the cycle or of having a less quiet or more quiet exhaust system at the mere touch of a button.

The advantages of the present invention may be best understood when it is realized that, perhaps the most unpleasant image of motorcycling in general arises from the loud, inappropriate noise level occasioned by motorcycles, particularly at night and/or in the inner city, or in residential areas, wherein cycles create a level of noise or sound that is unpleasant at best and intolerable at worst. Such noise-making motorcycles are often associated, rightly or wrongly, with anti-social behavior of various kinds.

Nevertheless, some owners believe that a motorcycle with a straight pipe exhaust (without a muffler) or one with little in the line of a muffler, is able to create higher performance levels. According to the invention, therefore, this loud noise potential may be realized when out in the country, on the open road, or at a drag strip or the like where loud noises are considered acceptable or even attractive.

For the last several years, manufacturers of motorcycles have been equipping their products with mufflers which have been increasingly effective to quit their cycles. This has placed current owners, who would prefer the louder cycles of a few years ago, in a dilemma. These riders could leave the cycles as they come from the factory, and have an unacceptably low noise level, or remove the mufflers, to create an open-pipe sound. However, since the noise level without any muffler would have to be lowered at least some of the time, to avoid tickets and other problems, these riders must resort to installing mufflers although at considerable inconvenience. The present invention allows such owners to have their choice of sound levels at the push of a button.

However, such an owner does not feel that undertaking major mechanical work to install or remove a muffler from his motorcycle is warranted, particularly after using it for perhaps only a short time, or for using it a number of times within a day during which periods of muffling are required or preferred.

Likewise, motorcycle owners do not prefer to dismount and adjust bypass valves or the like on thermally hot motorcycles, or cycles on which installations are necessary to emplace baffles, mufflers, etc.

A much more desirable system would include a remote push-button or switch to effortlessly change between modes, and any number of intermediate positions, thus changing between very loud and highly-muffled sound quickly and with little or no effort.

Consequently, it is an object of the present invention to provide a noise control system for a motorcycle which has the ability, merely by pushing a button, to change between the noise canceling option of a full muffler and a completely an unmuffled system, as well as any in-between noise level chosen by the operator.

Another object of the invention is to provide a system which will operate under the control of the rider in response to the mere pushing of a button.

A further object of the invention is to provide a choice of any degree of muffling that may be chosen by the rider whenever he prefers.

A still further object is to provide such a system which will enable the rider to achieve total control over the exhausts tone provided by his motorcycle without dismounting therefrom.

A further object is to provide a noise control system which operates with the aid of an electric motor.

Another object is to provide a rider-adjustable selection of stages between fully opened and fully muffled, and having the noise level adjustment remain there until changed by the operator.

A further object is to provide a remote opening and closing system which may be readily installed on a motorcycle A still further object of the invention is to provide a so-called linear actuator wherein the system causes a butterfly or similar valve to open and close, in response to a button or switch which is manually operable.

A further object is to provide system of opening and closing which is may be easily installed and which is very easy to adjust.

Another object is to provide a linear actuator which operates on the principle of a screw threaded device and in which the travel stops are definite and may be adjustable in use.

A still further object is to provide a system using a unique method and apparatus of stopping in open and closed positions at a predetermined point and having positive engagement for stopping yet being freely reversible from both stopped positions.

A further object of the invention is to provide a wire or cable feed mechanism which has an operating screw that is in turn actuated by gear system, preferably a planetary gear system.

Another object is to provide an outer sleeve or housing containing the parts mechanically necessary to operate a noise control mechanism, with the housing being closed at both ends and having only the operating wires or cables extending from one end thereof and electrical wires at the other end.

Another object of the invention is to provide a compact, self-contained arrangement including a reversible DC motor and screw drive system which includes at least one wire carrier with an operator-controlled switch mechanism.

Another object is to provide a wire carrier which rides on a pair of opposed elongated positioning guides and which operates between easily selected, adjustable limits, and is always freely reversible.

Another object is to provide a mechanism which is housed within a one-piece sleeve for isolation from the elements, especially in view of its being mounted on an exterior portion of the motorcycle.

SUMMARY OF THE INVENTION

These and other objects and advantages of the present invention are achieved in practice by providing a wire carrier and at least one operating wire, a linear actuator for controlling the movement of the wire carrier that is freely reversible in spite of how many times or how hard it is driven, a switch containing "open" and "close" modes as well as an "off" position, and at least one exhaust pipe having a straight-through mode as well as a closed position valve for directing the exhaust gases through an associated muffler.

DESCRIPTION OF THE PREFERRED EMBODIMENTS OF THE INVENTION

While the invention may be embodied in a number of forms and certain components may be able to be replaced by their equivalents, a description will be given of a typical embodiment of a linear actuator able to operate one or more wires which operate to ensure opening and closing of a butterfly valve enabling the exhaust gases either to pass through a muffler, or in another position, bypass the muffler and exhaust through a straight pipe. The unit is shown as being operable by a three-position switch enabling the butterfly valve to be fully opened, partially opened, or completely closed.

Figure 1:
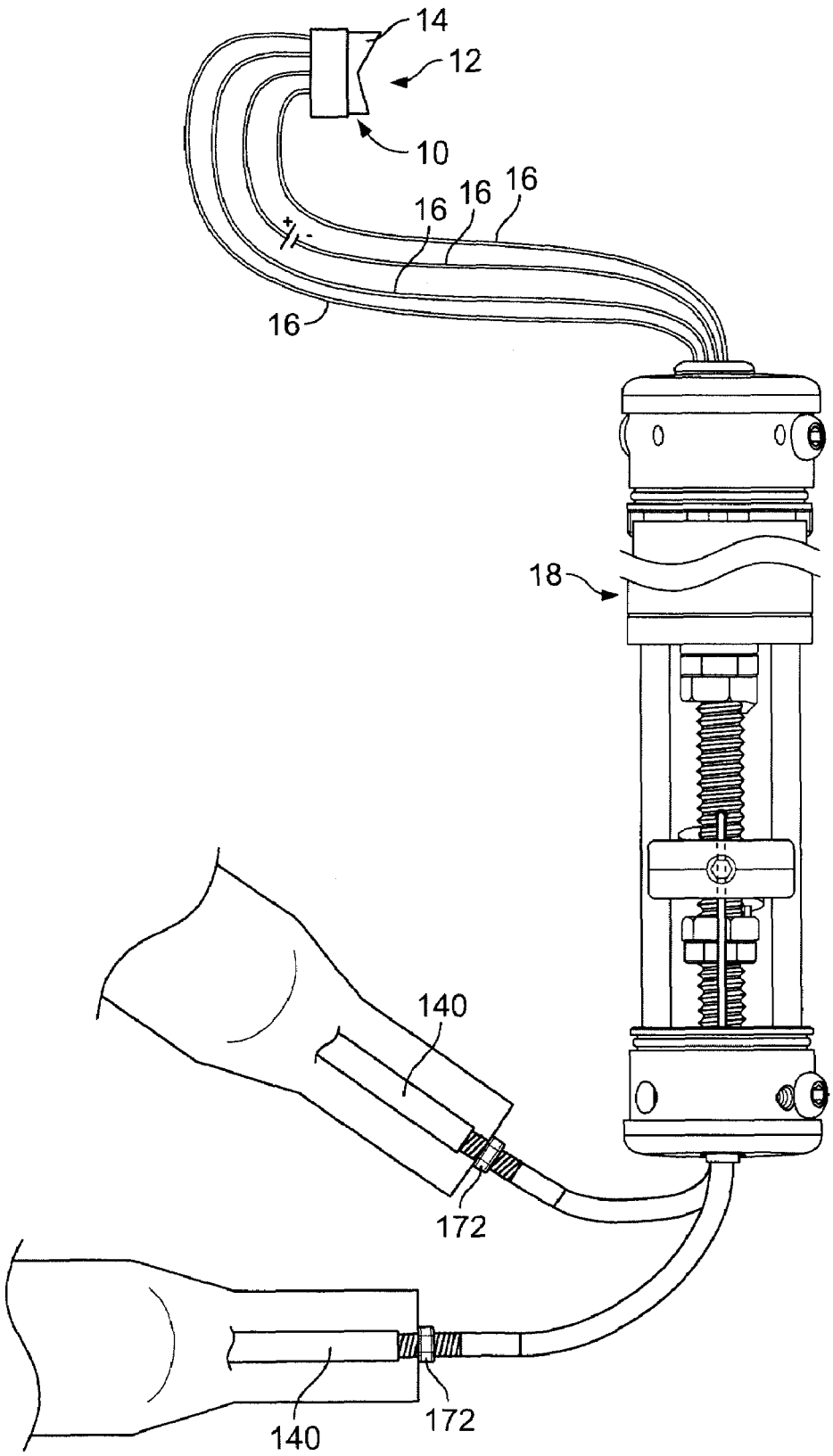
FIG. 1 is a side view, somewhat schematic, and with portions broken away, showing the operating switch, the linear actuator, and portions of two mufflers, the sound of which is controlled by valves operated by cables or wires from the linear actuator.
Figure 4:
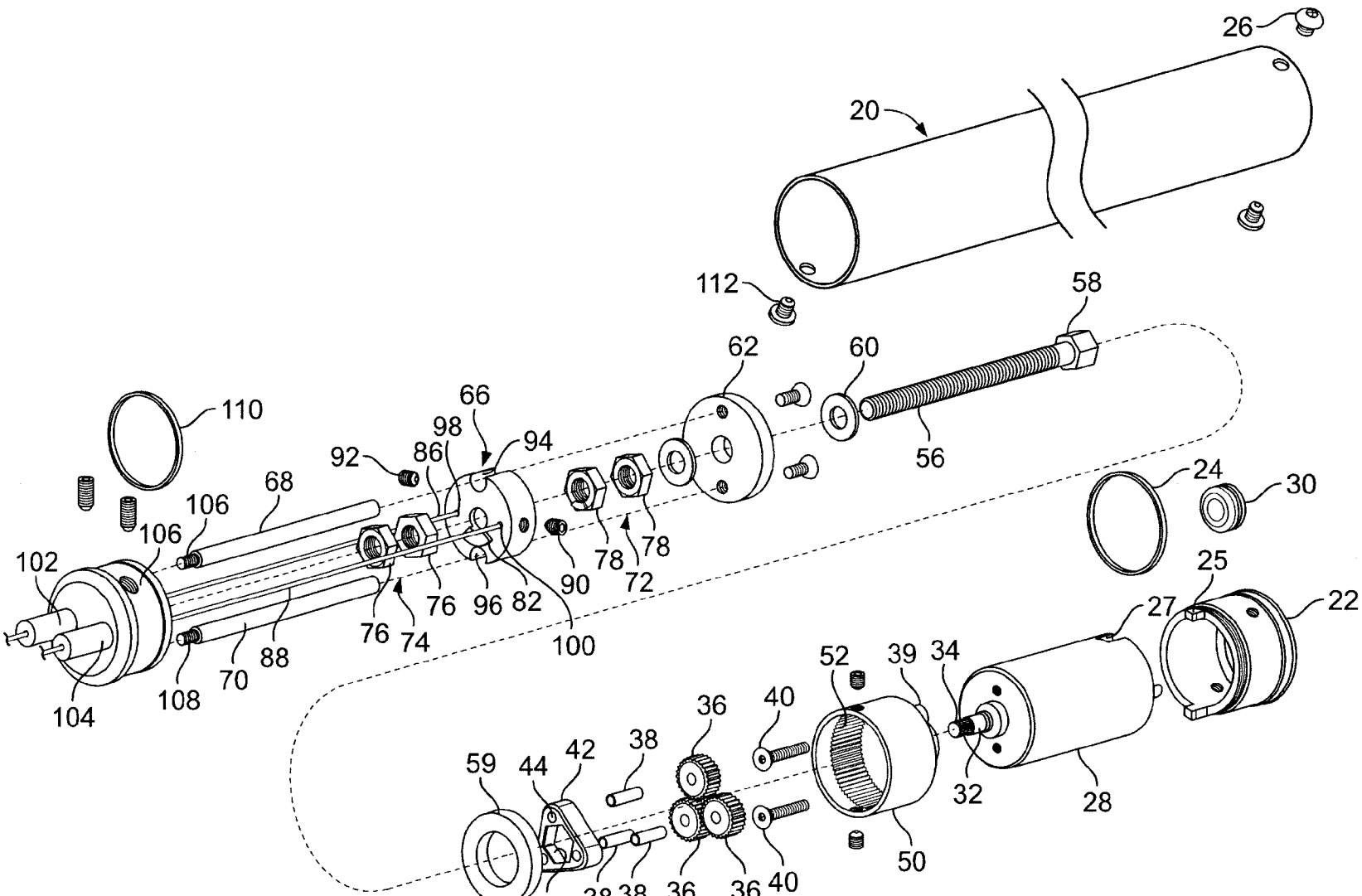
FIG. 4 is an exploded perspective view showing the various components of the linear actuator and some associated parts of the invention.

Referring now to the drawings in greater detail, there is shown in FIG. 1 a housing generally designated 10 which holds a three-position switch generally designated 12 including a selector 14, as well as the requisite four electrical wires 16 extending out to the motor and drive assembly of the linear actuator generally designated 18. The motor (not shown in detail in this Figure) and other components are shown in FIG. 4 to include a housing sleeve generally designated 20 having an end cap 22 sealed by an o-ring gasket 24. The end opposite the end on which the electrical wires enter the motor contains the cables 17 which enter the housing 140 as will be described later herein.

Referring again to FIG. 4, the end cap 22 is held in place by a set screw 26 and a positioning tab 25 which engages a notch 27 to secure a desired alignment of the housing 20. The drive motor itself 28 is sealed on one end in the sleeve 20 by a rubber grommet 30 and includes, on the opposite end thereof, a drive shaft 32 which terminates in a sun gear 34. The sun gear 34 drives three associated planet gears 36 whose axis of rotation is defined by three dowel pins 38. The rear end face 39 of the gear housing 50 is secured in place by two fasteners 40.

The planet gear carrier 42 is shown as being triangular in shape and includes three identical, cylindrical axially extending passages 44 for the dowel pins 38 which serve as axles for the planet gears 36. In addition, the central part of the carrier importantly includes a hollow opening arranged with drive means in the form of a hexagonal sidewall portion 46. There is shown a planetary gear housing 50 which includes a ring gear 52 having teeth on its inside. The ring gear 52 cooperates with the planet gears 36 and sun gear 34 when fully assembled to create a so-called planetary set, in which there is a driven rotary motion of the planet gear carrier 42.

Another important feature of the invention is the threaded rotary central drive shaft 56 of the linear actuation, which includes a hexagonal driving nut 58 integrally formed on one end thereof and passing through the other end of the gear box, through an Oilite™ thrust washer 60 and an end retainer plate 62. The contoured wire end positioning assembly generally designated 66 includes a number of features which will be described herein. The wire end positioning assembly 66 slides on a pair of bearing surfaces or guideposts 68, 70. The two stop assemblies generally designated 72, 74 includes a pair of movable positioning nuts 76, 76, and a pair of stop nuts 78, 78, each of which in use contacts the circumferentially facing, radially extending stop face 82 on the wire end positioning assembly 66. The nuts 76, 76 and 78, 78 are locked together by tightening them together when they achieve a desired axial position on the shaft 56. Once locked, the nut pairs remain in their set positions, unless intentionally unlocked. This would require manipulation by two wrenches.

In operation, which will be described in detail later, the wire end carrier assembly has the end portions of the wires 86, 88 adjusted for exact length and selectively locked in place by set screws 90, 92. The wire carrier assembly 66 engages the cutouts 94, 96, and the cutouts 94, 96 ride on the bearing surfaces 68, 70. The wire carrier assembly 66 includes a pair of openings 98, 100 for the wires 86, 88 to pass through. The wires, 86, 88 once secured in the openings 98, 100, also pass through cables 102, 104 inside cables 101, 103 in the end structure 107, as will appear. The threaded ends 106, 108 of the rods 68, 70 tightly engage the end structure 107. A gasket 110 and a housing set screw 112 complete the assembly.

Figure 2:
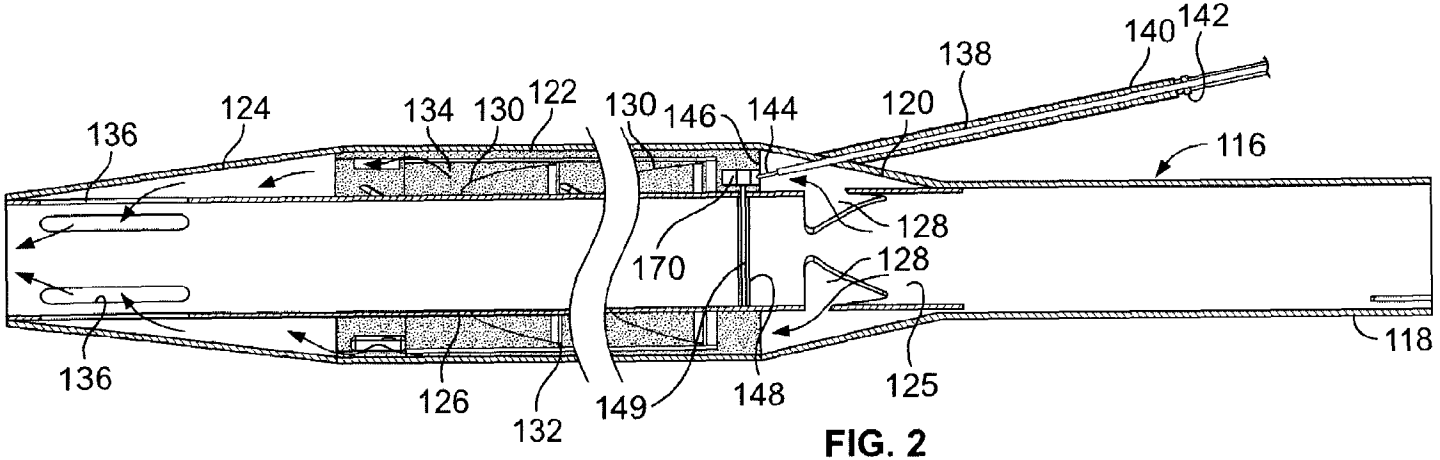
FIG. 2 is a vertical sectional view, with a portion broken away, showing the tail pipe and muffler assembly, the butterfly valve, the wire by which it is operated and other components in the controlled or low-noise mode.
Figure 2A:
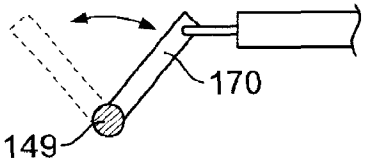
FIG. 2A is a fragmentary view, somewhat diagrammatically illustrating operation of the butterfly valve.
Figure 3:
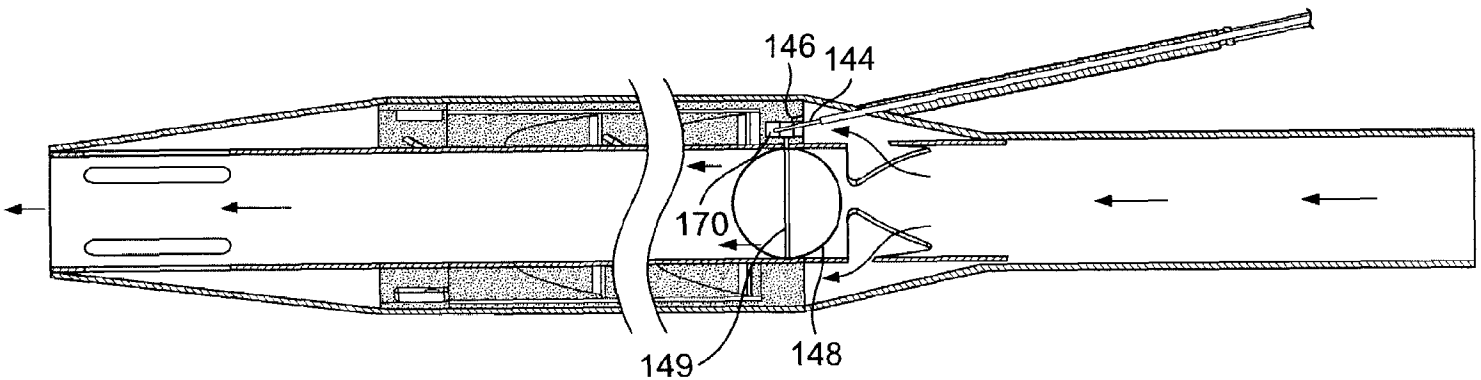
FIG. 3 is a view similar to FIG. 2 showing the apparatus in the loud noise or unmuffled mode.

Referring now to FIGS. 2 and 3, there is shown a preferred form of apparatus for controllably silencing a motorcycle engine. In FIGS. 2 and 3, there is shown a tailpipe assembly generally designated 116 which includes a tubular inlet portion 118, a front or forward cone 120, an enlarged diameter portion 122 preferably having an extended length and a rear cone 124. Lying inside the cones 120, 124 and the enlarged diameter portion 122 is an inner metal tube 126 which serves as the inside diameter of the muffler and which is considered a straight pipe for the exhaust system.

The inner tube 126 contains, at its right hand or inlet end 125, several bypass openings 128 in the inner tube 126, a plurality of baffles 130, and additional structure 132 for directing exhaust gases about in the interior space between the inner tube and the enlarged diameter outer portion 122. A plurality of packing materials 134 such as fiberglass, for example, are also preferably included in the annular space between the inner pipe and the outer diameter pipe. The interior tube 126 contains a plurality of outlets 136 therein at the end of the pipe to allow the muffled exhaust gases to pass out to the exterior atmosphere after transiently entering the annular space inside the outer tube 122.

Referring now to the relatively rigid operating wire 138, this wire passes through a small housing 140 which is preferably supported by welding to the front cone 120. The end portion 144 of the wire 138 is somewhat flexibly attached, as at a fitting 146, to a lever 170 which is in turn connected to the shaft 149 of a butterfly valve 148 which rotates to open and close the central passage in the tube 118 to the exhaust gases.

When the butterfly valve 148 is in a position wherein it blocks off the flow of exhaust gases directly through the inner pipe, the gases are then routed through the annular space between the outer pipe and the inner pipe 126, and through the various baffles and, optionally, other noise suppressing materials. When the butterfly valve is opened, as happens when the wire is pushed so as to move the butterfly valve 148 about the pivot point 149, the tailpipe assembly 116 is thus fully opened, allowing the exhaust gasses to pass unimpeded through the straight pipe assembly 126 with no interference, thus creating the loud, unmuffled sound.

Figure 5:
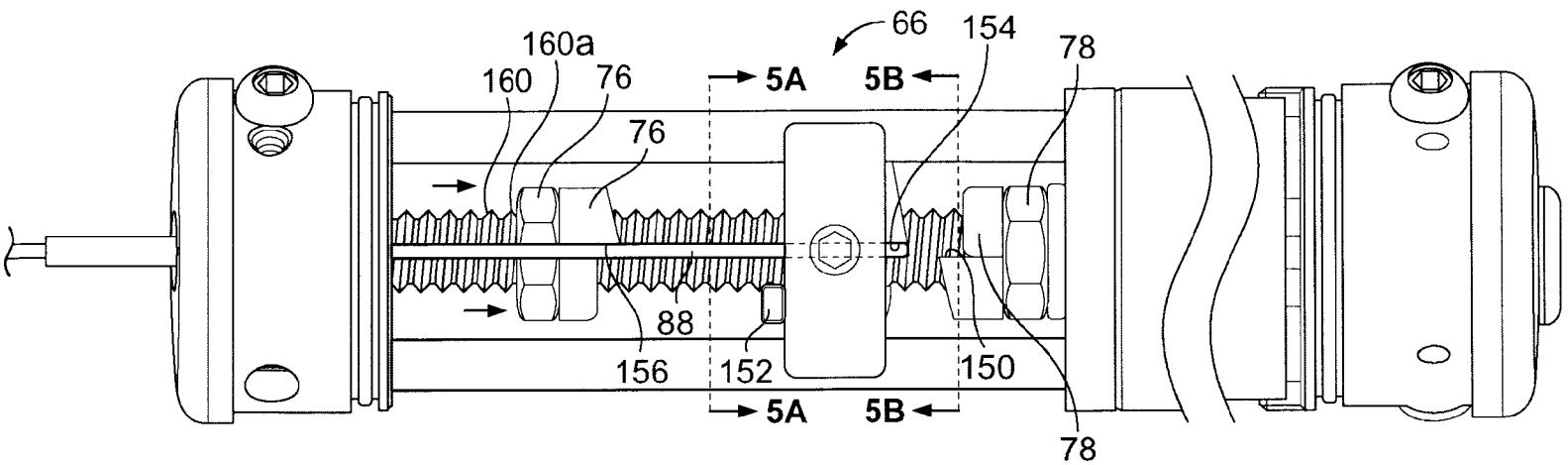
FIG. 5 is an enlarged view, with a portion broken away, of the linear actuator of FIG. 2.
Figure 5B:
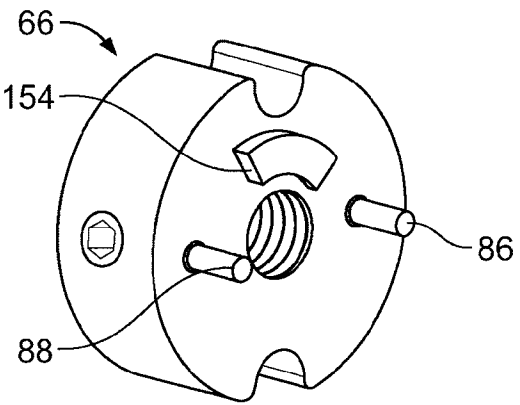
FIG. 5B is a similar view but showing the right hand face of the wire carrier.
Figure 5A:
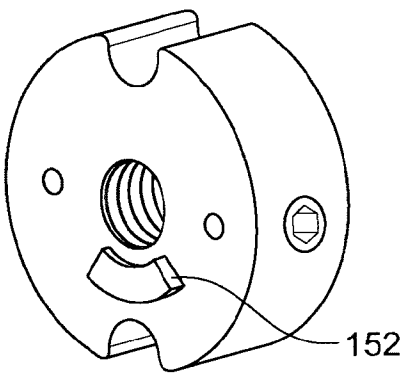
FIG. 5A is a perspective view of a portion of the wire carrier of FIG. 5, showing its left hand face.

Referring now to FIGS. 5, 5A and 5B, an illustration will be given of the operation of the linear actuator and the noise control system. Assuming that the wire carrier assembly 66 is in the position shown, that is, with the lock nut pairs 76, 78 being locked in position by tightening them against each other as shown in FIG. 5, the wire carrier 66 will move forward and backward as the drive shaft 56 rotates, within limits defined by the positions of the formations 159, 152, 154, 156 on the lock nuts 76, 78.

When the wire carrier assembly reaches the limit of its travel, as defined by the end faces 150, 154 or the faces 152, 156 engaging each other, the wires 86, 88 have been moved to their limits of travel, with the protrusions 150, 152 engaging the protrusions 154, 156 in a face-to-face relation. When the wire end carrier moves backward one full rotation of the drive shaft 56, because of the depth and pitch of the threads 160, 160A etc. the protrusion 152 will bypass the protrusion 156, and thus it will not engage its counterpart surface. Positioning of the nuts 77, 78 is decided upon by a procedure which will now be outlined.

Once the actuator and drive assembly designated 18 is secured in place on the cycle, and the housing 10 holding the switch 12 is mounted, for example, on the handle bars, electrical connections are made and fine tuning of the installation is called for. The sleeve 20 is slid up the electrical wires and the apparatus 18 is substantially in the position shown in FIG. 1. At this point, the length of travel between nuts 76, 78 is established, by noting how the butterfly valve(s) is opened/closed. The nuts 76, 78 are then tightened against each other and are in the positions shown in FIG. 1, or in some other similar position.

Then the wire end 88 is manipulated to ensure maximum opening and closing, in relation to the wire carrier 66. When the correct distance is selected, the set screws 90, 92 are then fastened and the wires 86, 88 are fixed in position. Thereupon the sleeve is placed over the mechanism and it is locked in place by the screws 26, 112. As a result, excessive travel of the wire end carrier 66 is not possible because of the lock nuts 76, 78 but these insure full rotation of the butterfly valve between fully open and fully closed positions. Fine adjustments can also be made where the outer cable 102 engages the fitting 172.

Referring now to certain variations which may be made in keeping with the present invention, the arrangement of the push button switch is subject to a number of variations. In the form illustrated, it includes one button having one position for opening the exhaust valve, another button going the other way for closing the exhaust valve and a neutral, or stop, position at any place in between the other two positions. The switch itself may be placed on the handlebars or may be placed on the linear actuator or elsewhere on the motorcycle.

The motor, as illustrated, runs a series of planetary gears which succeed in reducing the speed and having the ability to turn in either direction. Thus, a DC motor having the ability to operate in two directions is preferred. A planetary gear system has been illustrated, but there may be other ways of gearing the motor down, or even having a variable speed motor. The wires that operate the exhaust valves are shown as being relatively rigid wires which may operate to push or pull as the situation calls for.

The wires are sheathed in cables 102, 104 at the end portion of the linear actuator, much like the clutch or brake system on a mechanically actuated brake. Thus, the cables are shown as terminating where the cables enter the housing 140.

No particular number of exhaust pipes is shown, but with the two wires provided, it is implied that a twin or two-cylinder motorcycle would be used. However, the invention is equally applicable to a motorcycle with one, two, three or four or even more cylinders if so desired. The expedient of having a pair of locking nuts 78, 78 or 76, 76 is preferred. However, an arrangement which would cause the nuts or bolts to be of a single kind would be satisfactory.

Two bearing assemblies or guide posts 68, 70 are shown with the wire carrier assembly, but there might be just one guide. However, two or three guides are also acceptable. The arrangement of O-rings, washers, seals, outside sleeve, etc., in relation to the actuator 18 may be carried out according to the wishes of the user. The muffler assembly of the type shown is preferred. However, the exact form of the butterfly valve—whether it is square, round, or whatever shape inside the tube—is a matter left to the choice of the user. Having the baffles in the packing located in the annular space outside the straight inner pipe is the simplest way, but not the only way in which the desired results could be achieved. The muffler could have baffles, as illustrated, and also have a fiberglass or like packing. The illustration show the muffler having both baffles and a packing, but only one silencing apparatus could be use.

It will thus be seen that the present invention provides a novel method and apparatus for controlling the noise level of a motorcycle or other such vehicle, such as a snowmobile, an ATV or all-terrain cycle, etc., said method and apparatus having a number of advantages including those herein pointed out and other which are inherent to the invention.

What is claimed is:

1. A noise control apparatus for a motorcycle exhaust system, said apparatus including at least one exhaust pipe assembly having a direct pass-through mode and an indirect mode wherein exhaust gasses are directed through noise attenuating means, at least one valve for controlling exhaust gas flow between said direct and said indirect modes, a motor, a switch controlling said motor, a wire carrier, a wire connected between said carrier and said valve, and a rotary threaded drive shaft driven by said motor for moving said wire carrier, radially extending and circumferentially facing first stop means on both sides of said wire carrier and cooperating radially extending and circumferentially facing second stop means for engaging said wire carrier in each direction of travel, whereby said valve may be positioned under the control of said switch.

2. A noise control apparatus as defined in claim 1 which includes two exhaust pipe assemblies, one valve in each exhaust pipe for controlling exhaust gas flow and a wire for each valve, said wire being connected between said carrier and said valves.

3. A noise control apparatus as defined in claim 1 wherein said stop means is located on two pairs of lock nuts and said wire carrier, said lock nuts being adjustably postionable.

4. A noise control apparatus as defined in claim 1 wherein said wire carrier runs in a pair of longitudinal guides, said wire carrier including cut out portions for engaging said guides.

5. A noise control apparatus as defined in claim 1 wherein said switch is remotely positioned relative to said motor and said carrier.

6. A noise control apparatus as defined in claim 1 wherein said switch controlling said motor includes a position for causing said carrier to move in one direction and another position to cause said carrier to move the opposite direction and a neutral position in which said cater maybe stopped at any time.

7. A noise control apparatus as defined in claim 1 wherein said motor comprises a DC motor.

8. A noise control apparatus as defined in claim 1 which includes a reversible DC motor and a set of planetary gears, said planetary gears driving said rotary threaded drive shaft.

9. A noise control apparatus as defined in claim 1 wherein said wire carrier includes a female threaded interior opening for receiving said rotary threaded drive shaft.

10. A noise control apparatus for a motorcycle exhaust system as defined in claim 1 wherein said at least one valve is movable between the open and closed positions, and any number of intermediate positions, said at least one valve being a butterfly valve movable in response to a wire having a stiff but flexible connection to an arm attached to the shaft of said butterfly valve.

11. A noise control apparatus as defined in claim 1 wherein said at least one exhaust pipe has a pass through mode on its inner pipe and has an outer shell with sound attenuating means in the annular space between said shells, said gases in said indirect mode being directed through said noise attenuating means.

12. A noise control apparatus as defined in claim 1 wherein said indirect mode comprises plural openings in said exhaust pipe that are constructed and arranged to direct said gas flow through a baffle-containing chamber when said valve is closed.

13. A noise control apparatus for a motorcycle exhaust system, said apparatus including two exhaust pipe assemblies each having a direct pass-through mode and each having a noise attenuating mode wherein exhaust gases are directed through a chamber having a plurality of baffles, at least two valves for controlling the flow of exhaust gases between said direct pass-through mode and said noise attenuating mode, a bi-directional electric motor, a three-position switch for controlling said motor, a wire carrier and at least one guide therefor, two wires connected between said wire carrier and two of said valves, a rotary threaded drive shaft driven by said motor for moving said carrier, first radially extending, circumferentially facing stop means associated with said drive shaft, and second radially extending, circumferentially facing stop means on both sides of said wire carrier, whereby said valves may be positioned between a direct pass-through mode, a noise attenuating mode and a number of intermediate positions, all under the control of said switch.

* * * * *